US008764114B1

(12) United States Patent
Frank et al.

(10) Patent No.: US 8,764,114 B1
(45) Date of Patent: Jul. 1, 2014

(54) READY TO ASSEMBLE SECTIONAL SOFA AND METHOD

(75) Inventors: Jeffrey A. Frank, Bethesda, MD (US); Glenn Laughlin, Sophia, NC (US)

(73) Assignee: Simplicity Sofas, Inc, High Point, NC (US)

( * ) Notice: Subject to any disclaimer, the term of this patent is extended or adjusted under 35 U.S.C. 154(b) by 254 days.

(21) Appl. No.: 13/088,500

(22) Filed: Apr. 18, 2011

(51) Int. Cl.
*A47C 4/02* (2006.01)

(52) U.S. Cl.
USPC ..... 297/440.16; 297/248; 297/440.14

(58) Field of Classification Search
USPC ..... 297/440.1, 440.15, 440.16, 440.21, 297/248, 440.14
See application file for complete search history.

(56) References Cited

U.S. PATENT DOCUMENTS

| | | | | | |
|---|---|---|---|---|---|
| 570,207 | A | * | 10/1896 | Harry | 297/358 |
| 2,466,204 | A | * | 4/1949 | Brown | 297/115 |
| 3,002,787 | A | | 10/1961 | Ziegenfuss | 297/249 |
| 3,221,348 | A | * | 12/1965 | Siegel | 297/440.16 |
| 3,658,382 | A | * | 4/1972 | Anderson | 297/451.8 |
| 3,973,800 | A | | 8/1976 | Kogan | 297/440 |
| D298,389 | S | | 11/1988 | Culler | D6/335 |
| 5,145,234 | A | * | 9/1992 | Gualtierotti et al. | 297/440.16 |
| D337,002 | S | | 7/1993 | Gibson | D6/378 |
| 5,263,764 | A | | 11/1993 | Laughlin et al. | 297/440.23 |
| 5,314,234 | A | | 5/1994 | England | 297/248 |
| 5,338,095 | A | | 8/1994 | Laughlin et al. | 297/440.1 |
| 5,394,573 | A | | 3/1995 | Laughlin et al. | 5/18.1 |
| 5,423,596 | A | | 6/1995 | Laughlin et al. | 297/440.1 |
| D366,770 | S | | 2/1996 | Mabon | D6/336 |
| 5,601,340 | A | * | 2/1997 | Stout | 297/440.16 |
| D380,304 | S | | 7/1997 | Gera | D6/335 |
| D411,376 | S | | 6/1999 | Lewis et al. | D6/335 |
| 6,070,941 | A | * | 6/2000 | Chung | 297/440.16 |
| D446,950 | S | | 8/2001 | Leon et al. | D6/335 |
| 6,616,234 | B1 | * | 9/2003 | King | 297/383 |
| 6,637,812 | B2 | | 10/2003 | Laughlin et al. | 297/36 |
| 6,796,614 | B1 | * | 9/2004 | Paul | 297/440.14 |
| D504,029 | S | | 4/2005 | Ricci | D6/381 |
| 6,932,428 | B2 | * | 8/2005 | Murphy | 297/248 |
| 7,252,339 | B2 | * | 8/2007 | Owens | 297/440.1 |
| D587,028 | S | * | 2/2009 | Mourgue | D6/381 |
| 7,523,989 | B2 | | 4/2009 | Wieland et al. | 297/440.13 |
| 8,322,792 | B2 | * | 12/2012 | Chen | 297/440.1 |
| 2004/0095000 | A1 | | 5/2004 | Durling | 297/188.2 |
| 2012/0256464 | A1 | * | 10/2012 | Chang | 297/440.16 |

* cited by examiner

*Primary Examiner* — Peter Brown
(74) *Attorney, Agent, or Firm* — Novak Druce Connolly Bove + Quigg LLP

(57) ABSTRACT

A sectional sofa and method of assembly provides ease and convenience in the manufacture and use. The sectional sofa includes a central section having a seat and a pair of backs positioned approximately ninety degrees to each other forming a V-shaped opening therebetween. Affixed on each side of the central section is a side section which includes a back frame that can be easily inserted or removed into a seat frame as needed. End sections having a back frame, seat frame and an arm frame are affixed to each side section. Each back includes a pair of stakes which are slideably engaged within rectangular apertures in the seat frame for ease in manufacturing and stability in use. Additional standard bolts connect each section together for safety and convenience. The central section V-shaped opening allows for simplicity during construction and adds to the aesthetic qualities of the sofa design.

12 Claims, 10 Drawing Sheets

READY TO ASSEMBLE SECTIONAL SOFA AND METHOD

FIELD OF THE INVENTION

The invention herein pertains to sofas and particularly pertains to sectional sofas which are easy and ready to assemble and join section by section to form a desired size and seating capacity.

DESCRIPTION OF THE PRIOR ART AND OBJECTIVES OF THE INVENTION

Sectional sofas or "sectionals" have been known for many years and are generally upholstered with various fabrics and coverings. Such sofas are often formed with each section having a back and seat which are permanently joined and include back and seat cushions for comfort. Each section includes a frame which is covered by conventional padding with an outer fabric, leather or vinyl and can be releasably joined to other sections for stability purposes. Additional sections can be purchased by the owner for convenience in arranging seating for a particular room or area.

Most sectional sofas have sections which are unitary in construction, heavy and are cumbersome to move, repair and maintain. Large sectional sofas are expensive to manufacture and purchase and often lack aesthetic appeal for the majority of purchasers. Other sectional sofas are difficult to assemble during manufacture and require highly skilled craftsman.

Thus with the disadvantages and inefficiencies of sectional sofas currently available, the present invention was conceived and one of its objectives is to provide a ready to assemble sectional sofa with a seat and back which are manufactured separately and are easily assembled.

It is another objective of the present invention to provide a sectional sofa having a central section, side sections and end sections which are comfortable and appealing to the purchaser.

It is still another objective of the present invention to provide a sectional sofa which includes an appealing V-shaped opening along the back of the central section for simplicity and efficiency in manufacturing and assembly.

It is yet another objective of the present invention to provide a sectional sofa which can be adjusted by adding sections as needed by the purchaser.

It is a further objective of the present invention to provide a sectional sofa which can be offered with various patterns, colors, materials or fabrics.

It is still a further objective of the present invention to provide a sectional sofa which is practical, durable and comfortable which can be easily moved or rearranged as desired.

It is yet a further objective of the present invention to provide a sectional sofa which is relatively light in weight yet strong and suitable for any decorative environment.

Various other objectives and advantages of the present invention will become apparent to those skilled in the art as a more detailed description is set forth below.

SUMMARY OF THE INVENTION

The aforesaid and other objectives are realized by providing a ready to assemble sectional sofa which can be simply manufactured, assembled and conveniently used by consumers. The sectional sofa includes a central section having a seat frame with a pair of apertures therein on adjoining sides for receiving a pair of stakes affixed to each of a pair of back frames for slidable engagement. Between the back frames of the central section a V-shaped opening is formed which is aesthetically pleasing. The pair of stakes affixed to each back frame are positioned at an obtuse angle to the back frames for rigidity when assembled and to allow comfort to the person seated thereon. Each back frame is rectangularly shaped and reinforced by gussets. The cross section of each back frame stake is rectangular in shape for insertion into rectangular apertures in the seat frame. The central section is formed with two back frames attached to a single seat frame having the aperture pairs positioned perpendicularly. Side sections having a seat frame and a back frame and end sections having a seat frame, a back frame and an arm frame are disclosed which can be easily attached to a central section to form an L-shaped sectional sofa or otherwise depending on the consumer's desired seating arrangement. Standard bolts are rigidly affixed to the back frame which are received within apertures in the seat frame and are tightened with nuts or threaded knobs therebeneath.

The method of assembly describes insertion of the back frame stakes into the apertures of the seat frames to form a section and joining of the various sections for simplicity in manufacturing, assembly, moving and placement of the sectional sofa.

DETAILED DESCRIPTION OF THE PREFERRED EMBODIMENT AND OPERATION OF THE INVENTION

Figure 1:
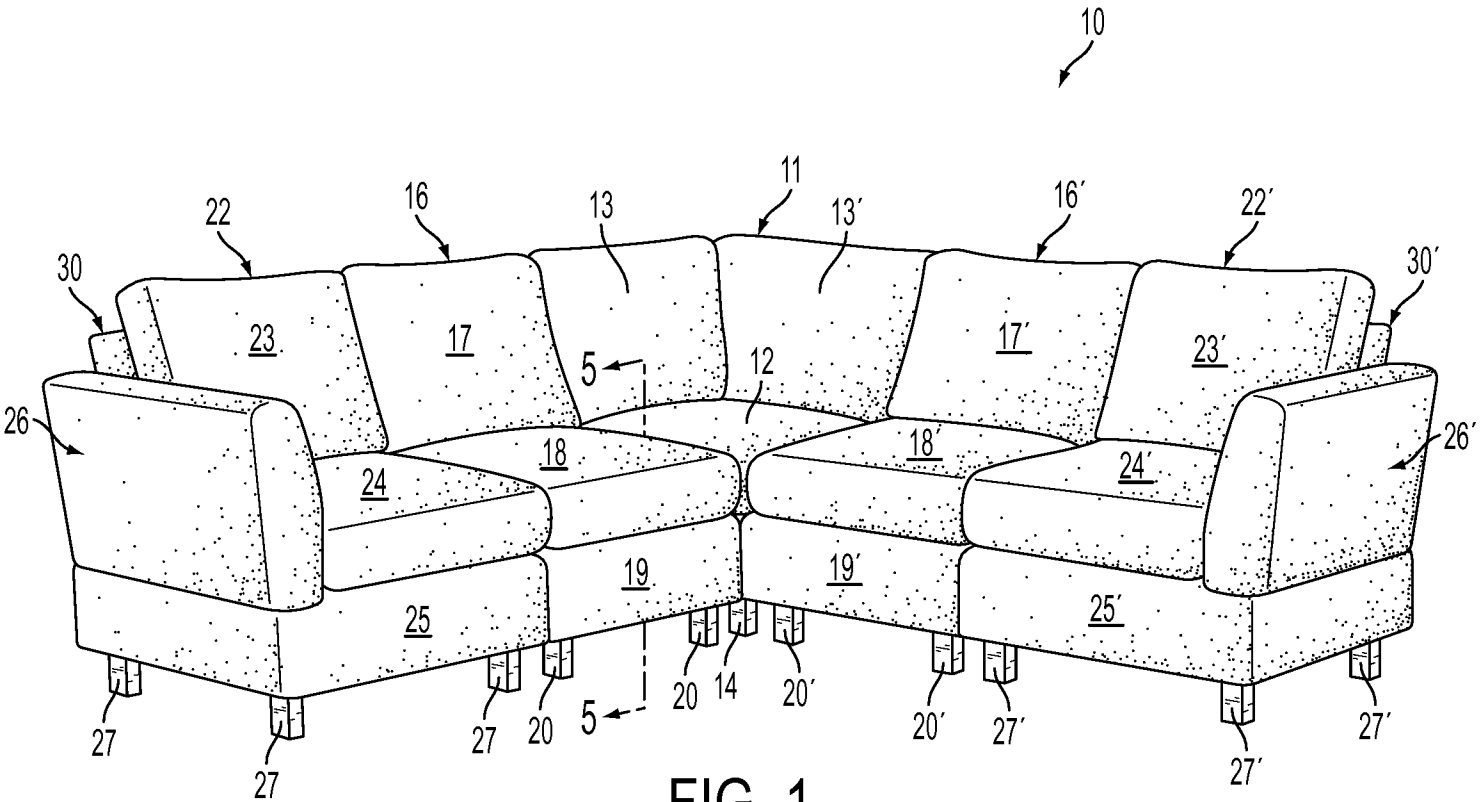
FIG. 1 shows a front perspective view of the sectional sofa of the invention.

For a better understanding of the invention and its operation, turning now to the drawings, FIG. 1 shows a front perspective view of preferred sectional sofa 10 having central (corner) section 11 with seat cushion 12 and two upholstered back cushions 13, 13'. Leg 14 is connected to central section with three (3) additional legs 14 (not shown) as conventional. Preferred central section 11 is joined on each side to side sections 16, 16' having respectively, back cushions 17, 17' and seat cushions 18, 18' on fabric covered seats 19, 19' supported by legs 20, 20'. Joined to each of side sections 16, 16' are end sections 22, 22' respectively, having back cushions 23, 23', seat cushions 24, 24' on fabric covered seats 25, 25' supported by legs 27, 27' and having upholstered arms 26, 26' affixed thereto.

As would be understood, additional side sections 16, 16' can be added to increase the size (length) and seating capacity of sectional sofa 10 such as by adding additional side sections 16, 16' on each side between respectively side sections 16, 16' and end sections 22, 22' as shown in FIG. 1 or between side sections 16, 16' and central section 11. More or less side sections 16, 16' can be used as desired to expand or contract the size (length) of sectional sofa 10 for a particular room, lobby or the like. Sectional sofa 10 can come in any of a variety of colors, fabrics or other coverings such as leather or vinyl.

Figure 2:
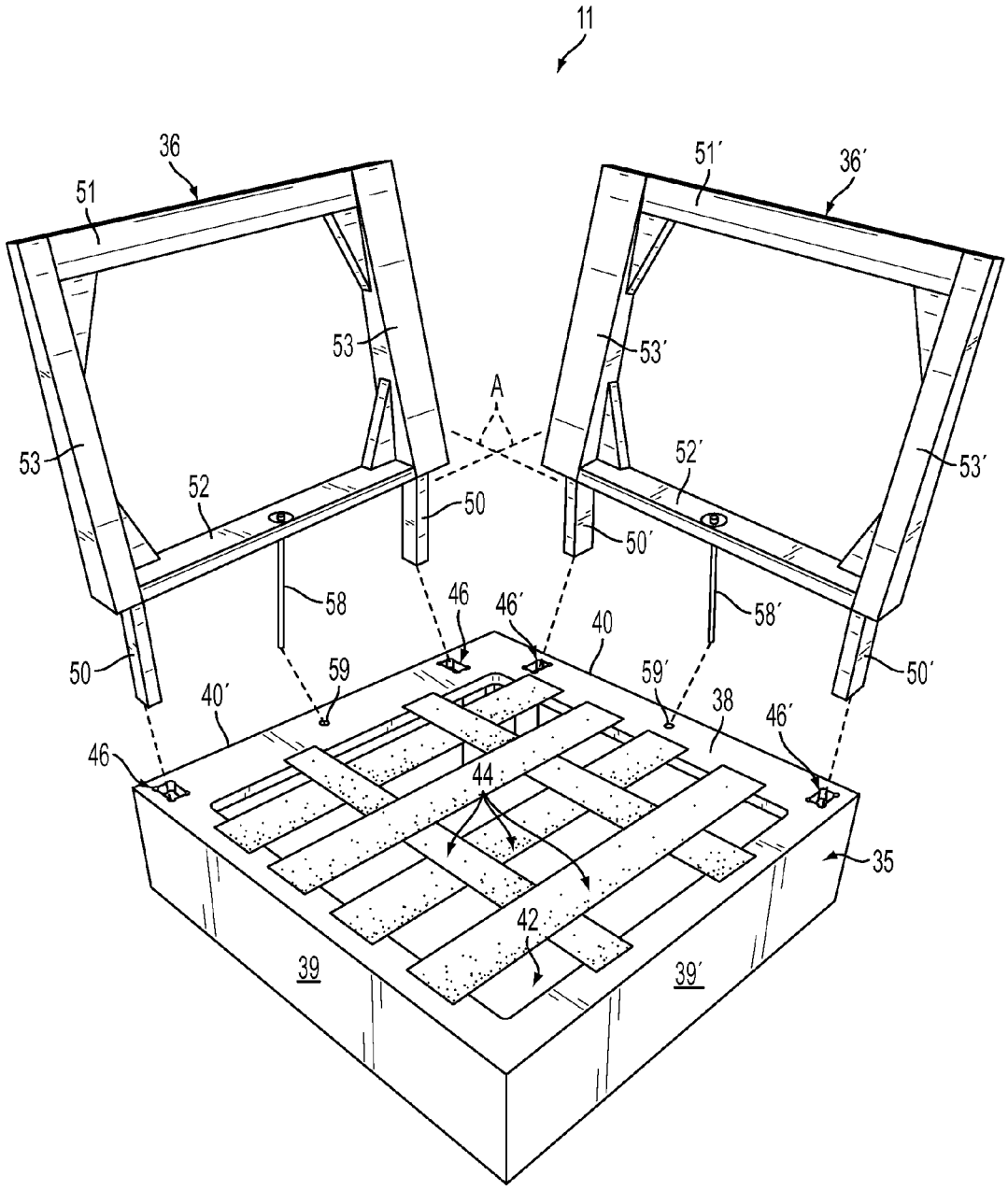
FIG. 2 demonstrates the seat and back frames of the central section in exploded format.
Figure 3:
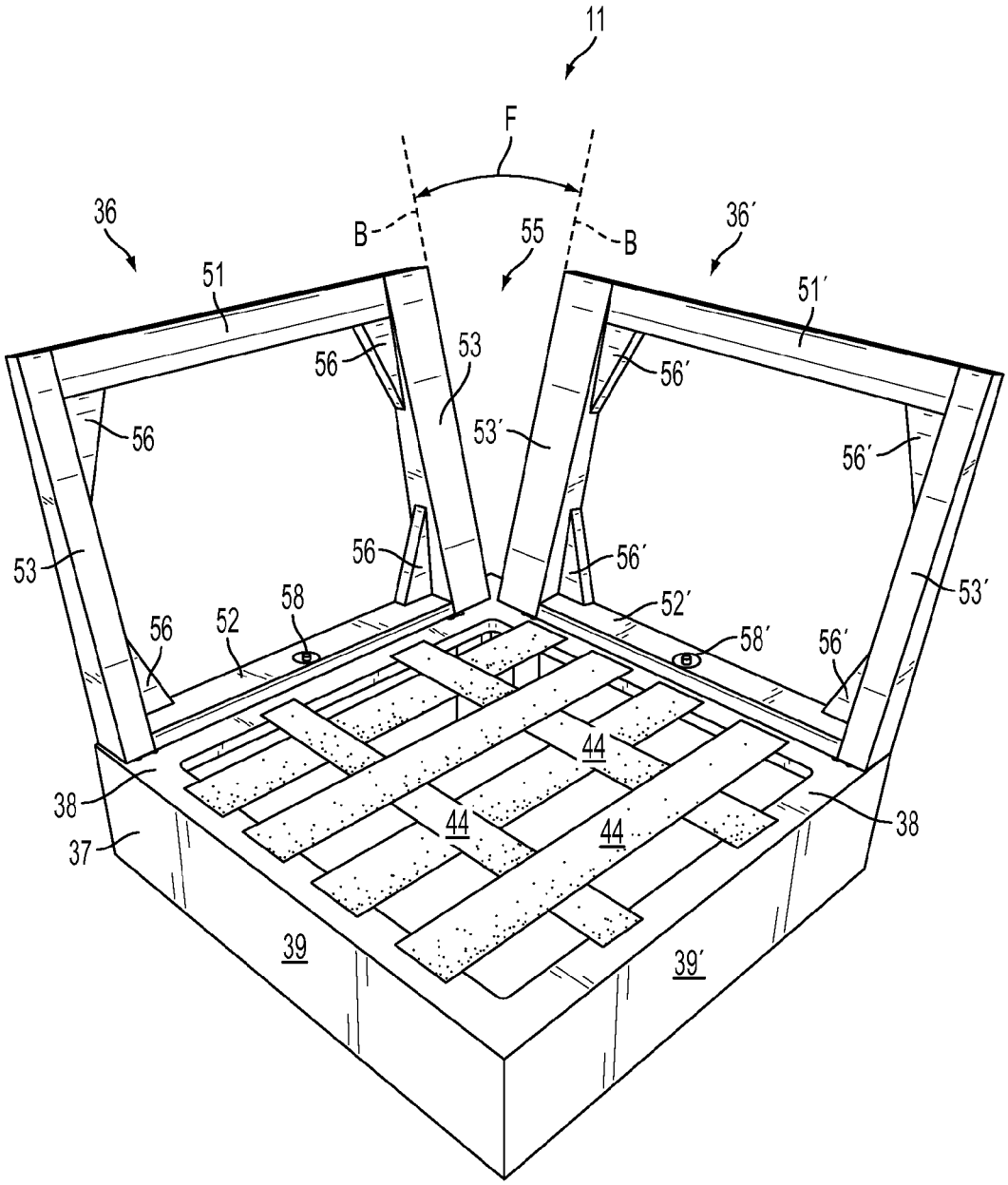
FIG. 3 illustrates the central section as seen in FIG. 2 in assembled fashion.
Figure 4:
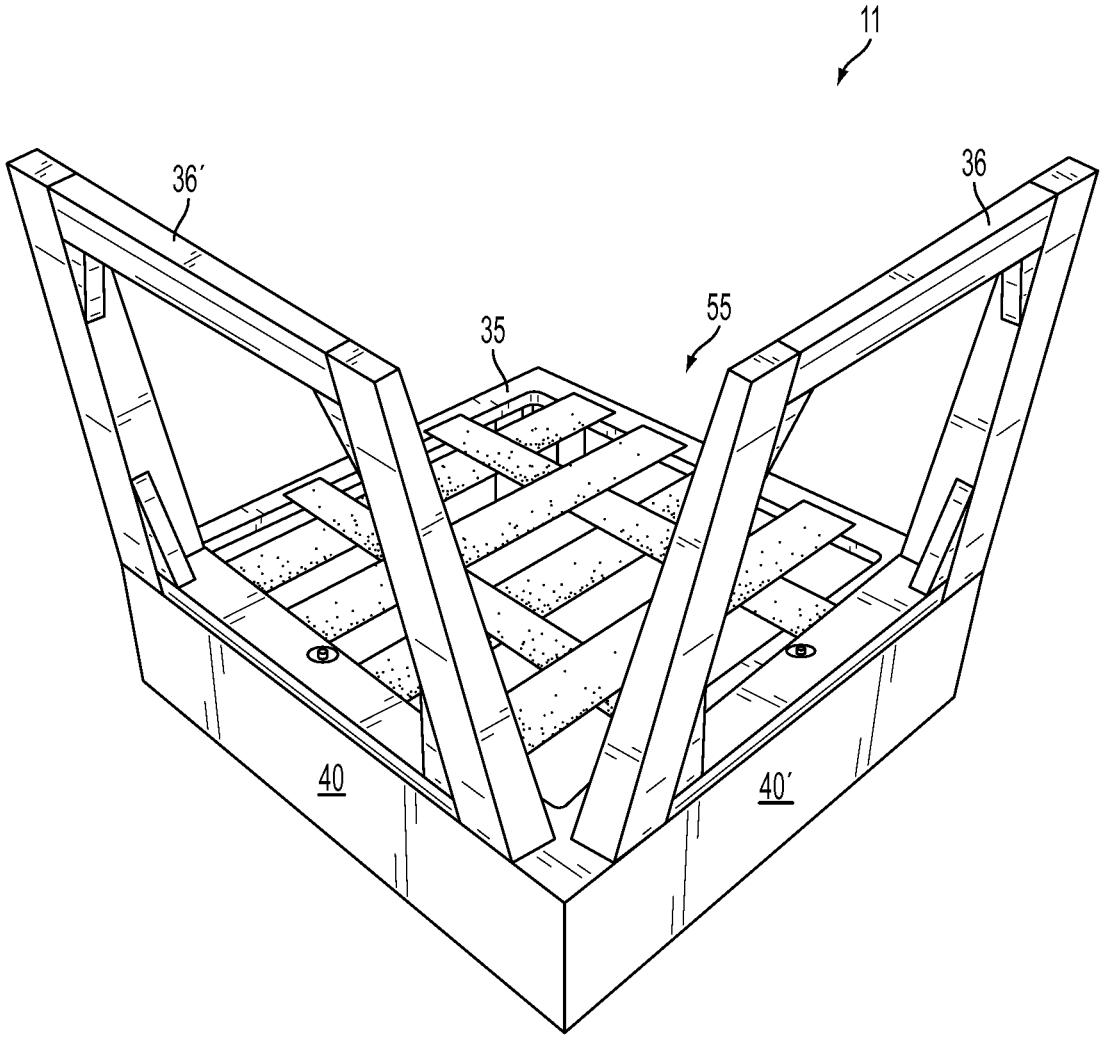
FIG. 4 pictures the central section of FIG. 3 in a rear view.
Figure 5:
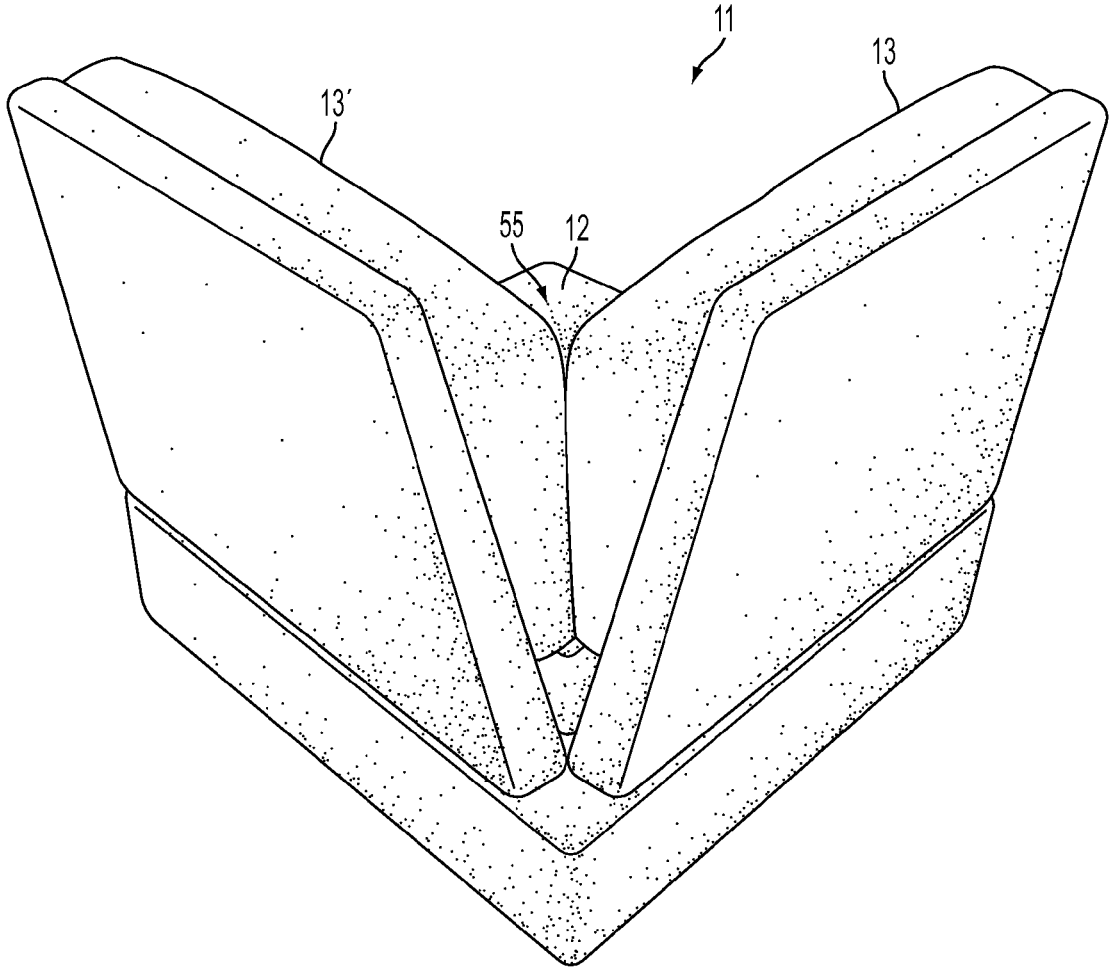
FIG. 5 shows the central section of FIG. 4 covered with padding, covering and seat and back cushions.

In FIG. 2 a front perspective view of central section 11 without any padding, covering or cushions is shown with back frames 36, 36' exploded from seat frame 35. Seat frame 35 includes top 38 which is joined to four sides 39, 39', 40 and 40' as conventional using adhesive, screws, nails or the like (not shown). Seat frame 35 includes a large central opening 42 in top 38 having conventional nylon straps or webbing 44 positioned thereacross. Webbing 44 is interlaced for additional strength and support and is connected to top 38 such as by staples or other conventional fasteners (not shown). Rectangular stake aperture pairs 46, 46' are formed in top 38 for reception of respectively stakes 50, 50' which are joined to respectively back frames 36, 36'. Brace blocks 77 are affixed underneath seat frame 35 proximate each of apertures 46, 46' as seen in dotted line fashion in FIG. 6. Brace blocks 77 (only one shown) assist in bracing stakes 50, 50' and providing rigid support thereto. As shown, back frames 36, 36' are positioned perpendicularly to each other as shown by dashed lines A, A (FIG. 2) along top 38 after assembly and form V-shaped opening 55 therebetween as seen in FIG. 3. Back frames 36, 36' form angle F therebetween of approximately thirty degrees (30°) as shown by imaginary lines B, B in FIG. 3. Back frames 36, 36' include respectively top frame members 51, 51', bottom frame members 52, 52' and a pair of side frame members 53, 53', joined together in rectangular fashion with standard adhesives, nails, staples or the like (not shown). Each corner of rectangular back frames 36, 36' includes respectively gussets 56, 56' for strength and durability. Gussets 56, 56' as shown in respective back frames 36, 36' are held in place with adhesives, nails, staples or other standard fasteners (not shown). As also shown in FIGS. 2 and 3, back frame stake pairs 50, 50' are inserted into respectively seat aperture pairs 46, 46' during assembly and rest against brace blocks 77 (FIG. 6) providing rigid support. In addition, threaded members 58, 58' which are conventional bolts are non-rotatable and rigidly affixed to bottom frame members 52, 52' through apertures (not shown) in respectively bottom frame members 52, 52'. Bolts 58, 58' are positioned in apertures 59, 59' of top 38 of seat frame 35 for additional joint strength and durability and are then tightened by nuts or threaded knobs (FIG. 6) beneath seat frame 35. More or less bolts 58, 58' can be used, depending on the exact dimensions and strength requirements of the back frame/seat connection. Although not shown as would be understood four (4) legs 14 are joined to seat frame 35, one at each corner, such as by nails, screws or other conventional fasteners (not shown). In FIG. 4, a rear view of assembled back frames 36, 36' and seat frame 35 of central section 11 is shown demonstrating V-shaped opening 55 as also shown in FIG. 3. FIG. 5 shows the assembled back and seat frames of central section 11 after covering and with seat cushion 12 and back cushions 13, 13' positioned thereon demonstrating V-shaped opening 55.

Figure 6:
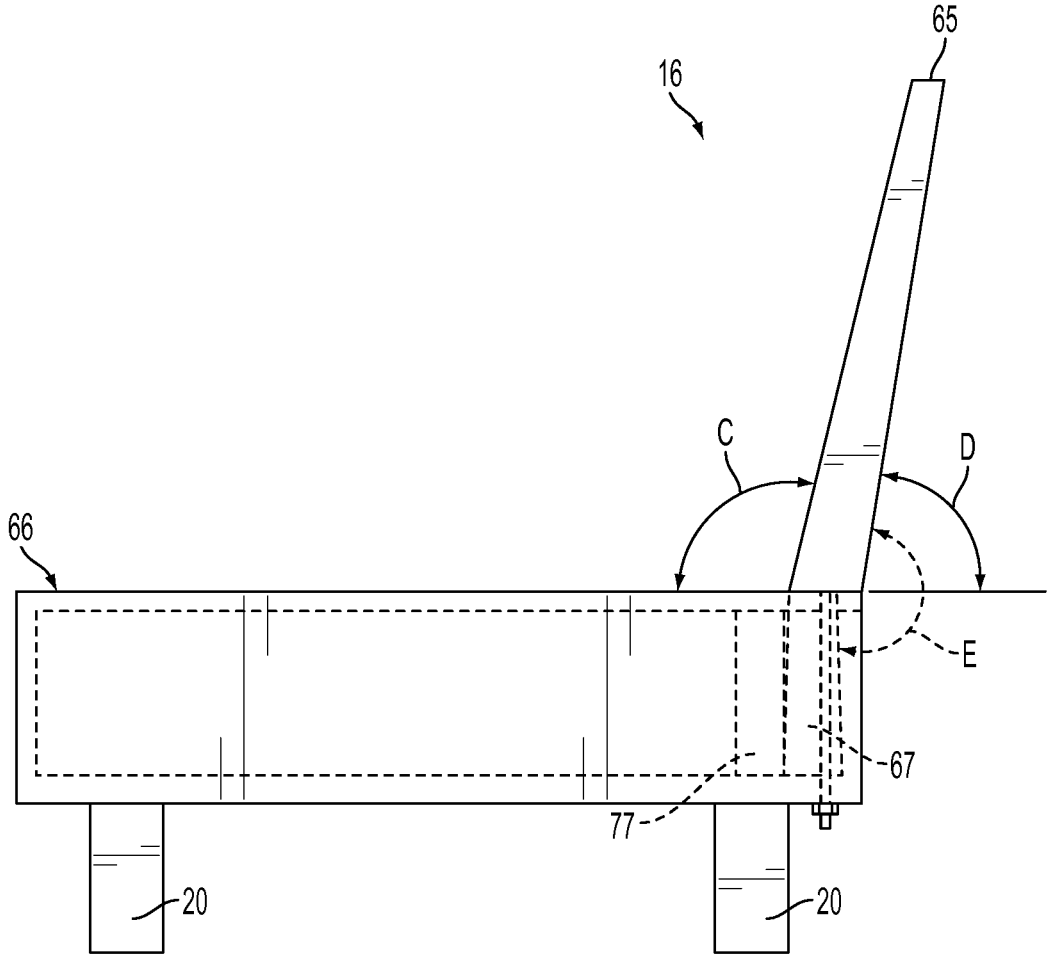
FIG. 6 depicts a side section in schematic form showing the back and seat frames assembled.

In FIG. 6, a schematic representation of side section 16 is shown in cutaway fashion without padding, covering or cushions demonstrating back frame 65 connected with seat frame 66 by stakes 67 as generally along lines 5-5 of FIG. 1. As seen, back frame 65 is disposed at acute angle C of approximately seventy-eight degrees (78°) for seating comfort when cushions (not shown) are in place. Stakes 67 are formed at obtuse angle E of approximately one hundred seventy degrees (170°) to the rear surface of back frame 65 which is about eighty-two degrees (82°) from the horizon as indicated at D. As would be understood back frame 65 is formed the same way as back frames 36, 36' (FIGS. 2 and 3) and seat frame 66 is formed the same way as seat frame 35 however only one pair of apertures is formed on one side in the seat top (not shown) for reception of stakes 67 of back frame 65. Although not shown side section 16' is formed in the same manner as side section 16. Side section 16 includes four (4) legs 20 (only two shown), while side section 16' includes four (4) legs 20' affixed thereto such as by nails, screws or other conventional fasteners (not shown).

Figure 7:
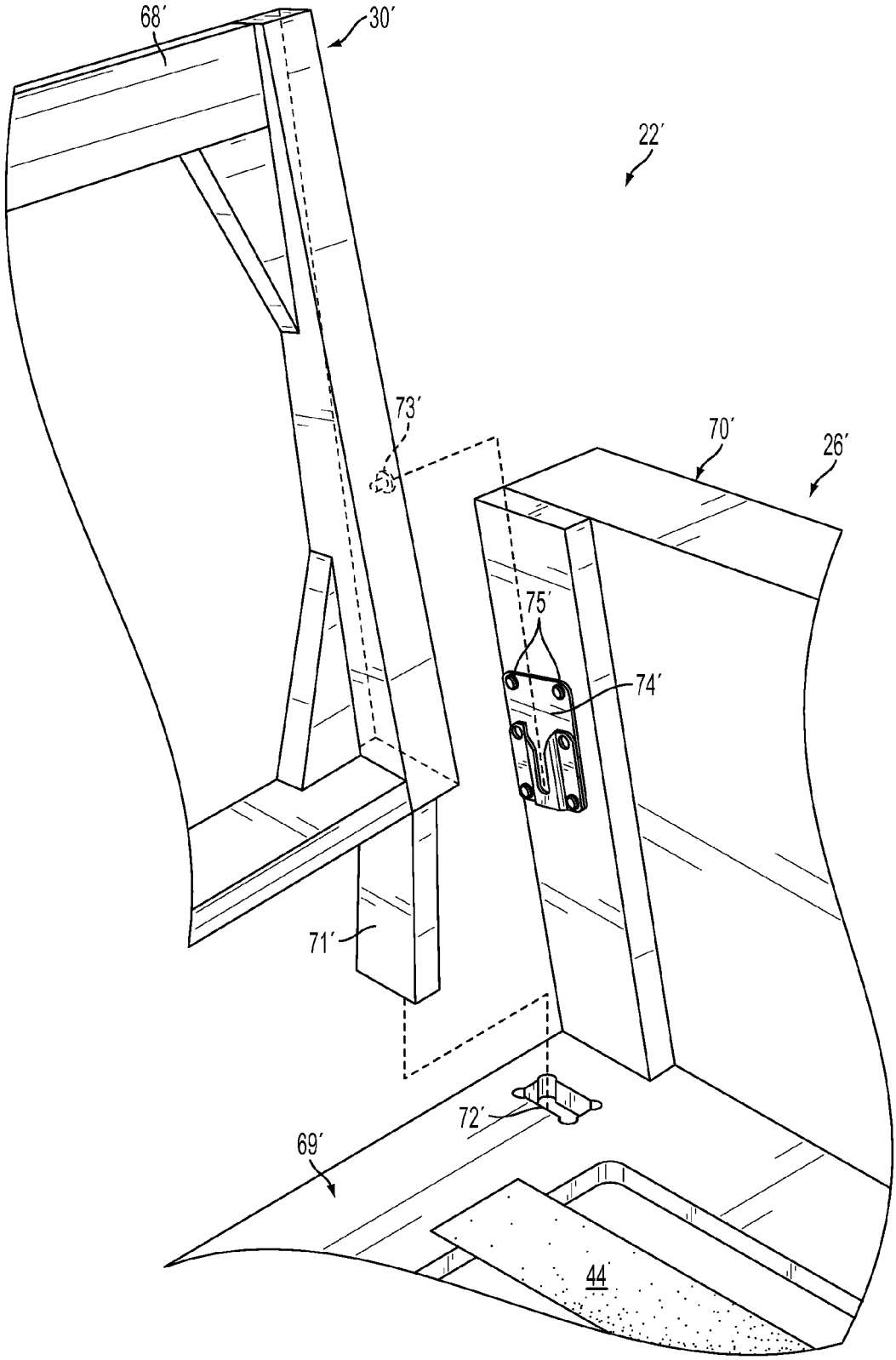
FIG. 7 features a view of the end section in schematic representation with the back frame exploded from the seat and arm frames.
Figure 8:
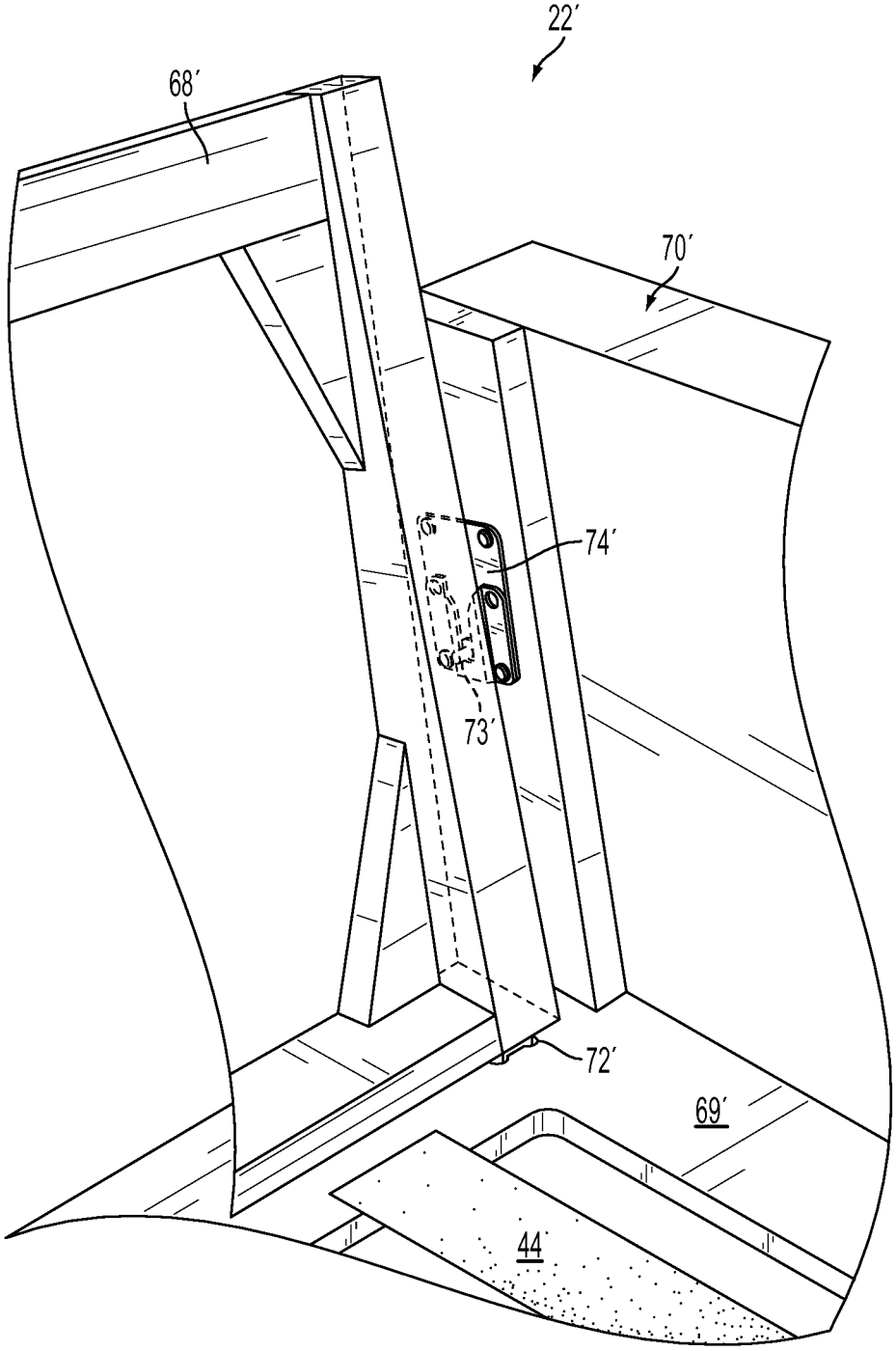
FIG. 8 shows the end section of FIG. 7 in assembled fashion.

Exploded end section 22' is schematically seen fragmented in FIG. 7 with padding, covering, cushions and the like removed for clarity. Back frame 68' is exploded from seat frame 69' and arm frame 70'. Specifically, back frame 68' of back 30' is exploded from arm frame 70' of arm 26' and seat frame 69' of seat 25' (shown in FIG. 1). As seen in FIG. 7, stake 71' having a rectangular cross-section is placed in rectangular seat frame aperture 72' while standard locking pin 73' affixed to the side of back frame 68' is slid into locking engagement with conventional clasp 74' mounted with wood screws 75' on the inside of arm frame 70'. Arm frame 70' is affixed to seat frame 69' by standard construction using screws, bolts, adhesives or the like (not shown). In FIG. 8, seat frame 69', arm frame 70' and back frame 68', seen in fragmented fashion are fully assembled. Back frames 68, 68', when padded and covered as is conventional, form backs 30, 30' shown in FIG. 1 behind cushions 23, 23'.

As would be understood back frame 68' is formed the same way as back frames 36, 36' (FIGS. 2 and 3) however includes locking pin 73' on one side thereof. Seat frame 69' is formed the same way as seat frame 35 however only one pair of apertures 72' is formed on one side in the seat top (not shown) for reception of stakes 71' of back frame 68', also seat frame 69' is wider along one side for reception of arm frame 70' of arm 26' as seen in FIG. 1. Although not shown end section 22 is formed in the same manner as end section 22' however mirrored such that seat frame 69 is wider along the opposite side for reception of arm frame 70 of arm 26 which is in opposing fashion to arm frame 70' of arm 26'. End section 22' includes four (4) legs 27' (only three shown), while end section 22 includes four (4) legs 27 affixed thereto such as by nails, screws or other conventional fasteners (not shown).

As would be understood after each of the frames are formed, the assembled frame sections are then padded and covered as is conventional. The back frame is affixed to the seat frame according to the particular section being made and if applicable the arm frame is affixed thereto. Seat and back cushions are then added to each section to provide comfortable seating which can then be joined together as described below to form a sectional sofa such as sectional sofa 10 seen in FIG. 1. Central section 11 includes one seat cushion 12 and two back cushions 13, 13' as further shown in FIG. 5.

Figure 9:
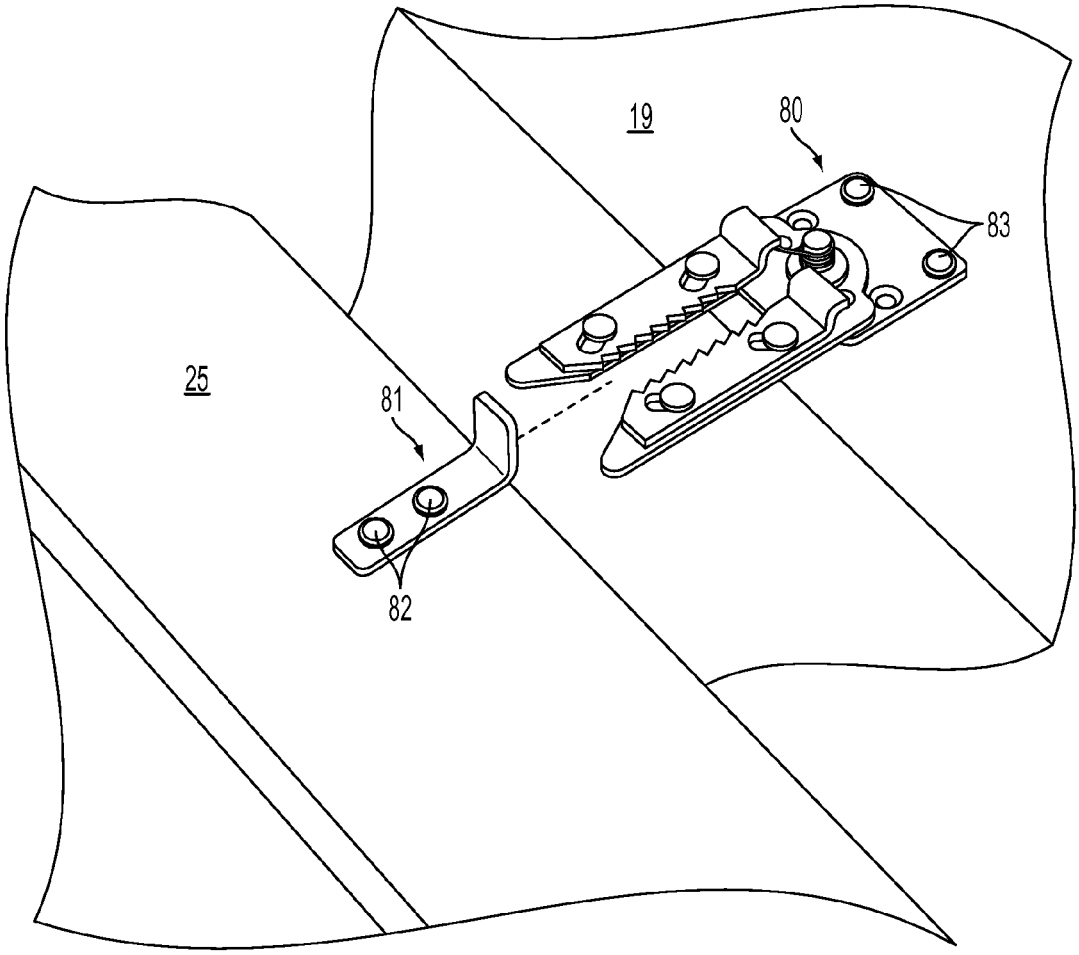
FIG. 9 depicts an underneath view of fragmented seats of side and end sections prior to engagement.
Figure 10:
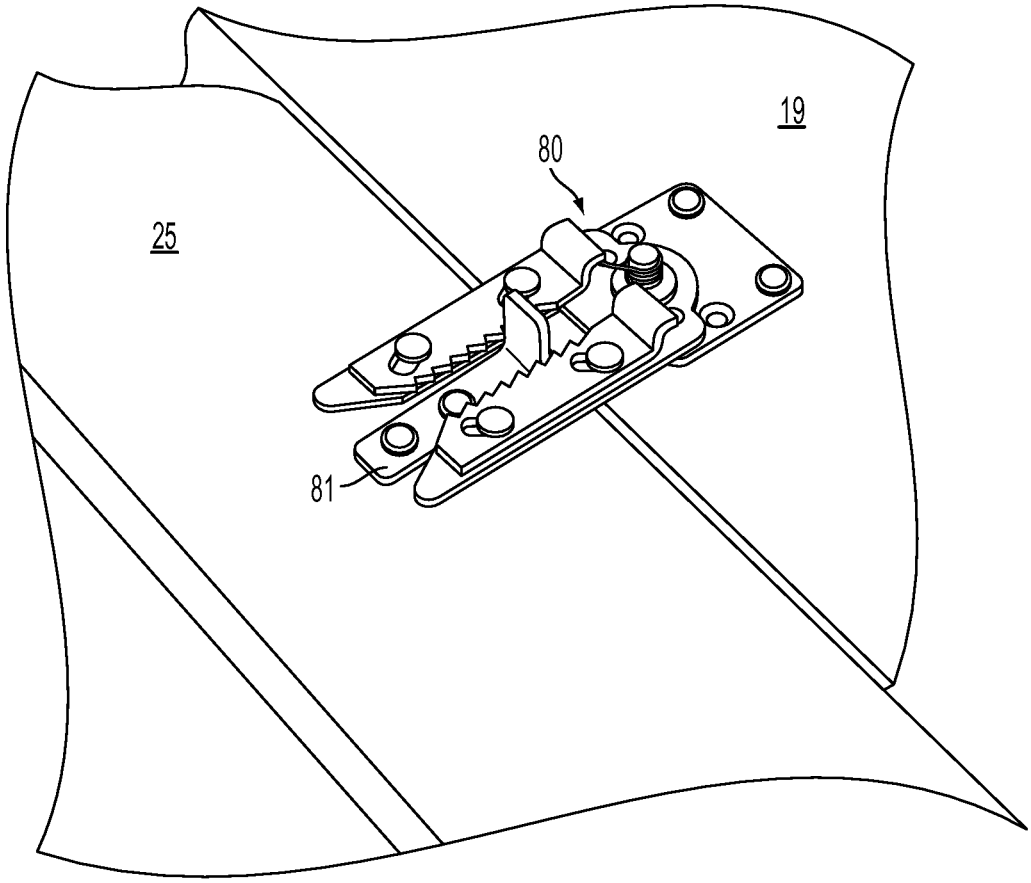
FIG. 10 illustrates the fragmented seats of FIG. 9 after engagement.

In order to secure the sofa sections in side-by-side engagement, such as end section 22 to side section 16, a conventional hasp such as hasp 80 as shown in FIG. 9 is affixed to the bottom of seat 19 (seen in partial view). Hasp 80 engages bracket 81 mounted on the bottom of seat 25 (seen in partial view) of end section 22. Other types of fasteners, clasps or the like could also be used. In FIG. 10 hasp 80 is shown engaged with bracket 81 to secure seat 25 to seat 19. Hasp 80 is held in place with wood screws 83 and bracket 81 is held in place with wood screws 82 although other usual fasteners may be used as desired. Hasp 80 also allows for disengagement whereby the teethed portions of hasp 80 could be slid outwardly and bracket 81 could be disengaged and end section 22 could be removed from side section 16 such as for moving purposes or for the addition of another side section 16 therebetween.

As would be understood hasp 80 and bracket 81 are provided on each of side sections 16, 16', while end sections 22, 22' employ either hasp 80 or bracket 81 depending on the side it will be on and central section 11 includes hasp 80 on one side and bracket 81 on the adjoining side for ease in alignment and connection of the various sections to form a safe and secure sectional sofa such as sectional sofa 10 shown in FIG. 1.

The method of using the invention includes the steps of forming a central section having a pair of back frames such as back frames 36, 36' each having a pair of stakes 50, 50' and bolts 58, 58' respectively attached thereto as seen in FIG. 2. Padding and selected fabric coverings (FIG. 5) are affixed as conventional in the trade. A seat frame such as seat frame 35 is provided with stake apertures 46, 46' and apertures 59, 59' formed therein whereby stakes 50, 50' are manually placed within stake apertures 46, 46' respectively with bottom frame members 52, 52' resting on seat top 38. Bolts 58, 58' are positioned respectively within apertures 59, 59' and are secured by threaded nuts (only one shown in FIG. 6) beneath seat frame 35 to firmly secure back frames 36, 36' to seat frame 35. Back cushions 13, 13' and seat cushion 12 are then added to form central section 11. Side sections 16, 16' and end sections 22, 22' with arms 26, 26' are likewise similarly assembled and are joined by hasps 80 and brackets 81 to central section 11 to form L-shaped sectional sofa 10 as seen in FIG. 1.

The illustrations and examples provided herein are for explanatory purposes and are not intended to limit the scope of the appended claims.

We claim:

1. A ready-to-assemble corner section of a ready-to-assemble sectional sofa, the corner section comprising:

a base; and two back sections configured to be removably attached to the base substantially perpendicularly to each other at a corner of the base, wherein, when attached to the base, the two back sections are spaced from the corner and form a substantially V-shaped opening in an upward direction at the corner, the substantially V-shaped opening being visible after complete assembly of the corner section, wherein each of the respective back sections includes a respective pair of unthreaded stakes, and wherein the base includes pairs of respective apertures configured to receive the respective pairs of unthreaded stakes of the respective back sections, wherein each of the respective back sections further includes a respective threaded rod member disposed between the respective pair of unthreaded stakes, and wherein the base further includes respective apertures configured to receive the respective threaded rod members of the respective back sections, wherein the threaded rod members are configured to removably attach the respective hack sections to the base.

2. The corner section of claim 1, further comprising:

a base cushion; and two back cushions configured to rest against the respective back sections.

3. The corner section of claim 1, wherein the base further includes a frame having respective brace blocks corresponding to the apertures configured to receive the stakes, wherein the brace blocks are configured to substantially prevent wiggling of the back sections when attached to the base.

4. The corner section of claim 1, wherein the respective back sections are pitched outward, relative to sides of the base, the respective back sections thereby forming respective angles of less than 90° with the base, considered in an outward direction relative to the base.

5. The corner section of claim 1, wherein, after assembly, assembly-related hardware is not visible.

6. A ready-to-assemble sectional sofa comprising:

the ready-to-assemble corner section of claim 1; and one or more further ready-to-assemble side sections configured to be attached to the corner section.

7. The sectional sofa of claim 6, wherein at least one of the further sections comprises at least a side section base, and a side section back section configured to be removably attached to the side section base.

8. The sectional sofa of claim 7, wherein the side section back section includes a pair of stakes, and wherein the side section base includes a pair of apertures configured to receive the pair of stakes of the side section back section.

9. The corner section of claim 8, wherein the side section back section further includes a threaded member, and wherein the side section base further includes an aperture configured to receive the threaded member of the side section back section, wherein the threaded member is configured to removably attach the side section back section to the side section base.

10. The sectional sofa of claim 7, further comprising a side section base cushion and a side section hack cushion configured to rest against the side section back section.

11. The sectional of claim 6, wherein at least one of the one or more further ready-to-assemble side sections is an end section that includes an arm section configured to be removably attached to a side of the side section base of the end section, substantially perpendicularly to the side section back section.

12. The sectional sofa of claim 6, wherein, after assembly, assembly-related hardware is not visible.

* * * * *